US008991823B2

(12) United States Patent
Sato et al.

(10) Patent No.: US 8,991,823 B2
(45) Date of Patent: Mar. 31, 2015

(54) IMAGE FORMING APPARATUS WITH MOVABLE FEED GUIDE

(71) Applicants: Kabushiki Kaisha Toshiba, Tokyo (JP); Toshiba Tec Kabushiki Kaisha, Tokyo (JP)

(72) Inventors: Tetsuya Sato, Kanagawa-ken (JP); Kazutoshi Takahashi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/060,034

(22) Filed: Oct. 22, 2013

(65) Prior Publication Data

US 2014/0110899 A1 Apr. 24, 2014

(30) Foreign Application Priority Data

Oct. 22, 2012 (JP) ..... 2012-233267

(51) Int. Cl.
*B65H 29/58* (2006.01)
*B65H 9/00* (2006.01)
*B65H 7/02* (2006.01)

(52) U.S. Cl.
CPC ..... *B65H 9/00* (2013.01); *B65H 29/58* (2013.01); *B65H 7/02* (2013.01); *B65H 2402/46* (2013.01); *B65H 2511/212* (2013.01); *B65H 2511/414* (2013.01); *B65H 2801/06* (2013.01)
USPC ..... 271/303; 271/184; 399/21

(58) Field of Classification Search
CPC ..... B65H 29/58; B65H 2404/513; B65H 2404/611; B65H 2404/63; B65H 2404/632; G03G 2221/1675
USPC ..... 271/184, 303–305; 399/21, 401
See application file for complete search history.

(56) References Cited

U.S. PATENT DOCUMENTS

| | | | | |
|---|---|---|---|---|
| 7,092,646 | B2 * | 8/2006 | Schroath et al. | 399/21 |
| 7,403,721 | B2 * | 7/2008 | Yamada | 399/21 |
| 7,448,621 | B2 * | 11/2008 | Yasumoto | 271/264 |
| 7,515,866 | B2 * | 4/2009 | Togashi et al. | 399/381 |
| 7,519,313 | B2 * | 4/2009 | Jang | 399/124 |
| 7,871,076 | B2 * | 1/2011 | Yuzawa et al. | 271/303 |
| 8,340,535 | B2 * | 12/2012 | Uehara | 399/21 |
| 8,442,421 | B2 * | 5/2013 | Ichiki et al. | 399/401 |
| 2002/0038936 | A1 * | 4/2002 | Fujisawa et al. | 271/278 |
| 2006/0193666 | A1 * | 8/2006 | Tomatsu | 399/401 |
| 2007/0196127 | A1 * | 8/2007 | Kubo et al. | 399/124 |
| 2010/0034559 | A1 * | 2/2010 | Sahara | 399/122 |
| 2011/0044704 | A1 * | 2/2011 | Uehara | 399/21 |
| 2012/0086166 | A1 * | 4/2012 | Kim | 271/303 |

* cited by examiner

*Primary Examiner* — Patrick Cicchino
(74) *Attorney, Agent, or Firm* — Patterson & Sheridan LLP

(57) ABSTRACT

An image forming apparatus according to an embodiment comprises a feed guide forming a feed path of a sheet and having an end portion movable between a closed position and an open position by rotating around a shaft, wherein the end portion is positioned above the shaft when the feed guide is in the open position, and the feed guide is configured to provide access for removal of a jammed sheet when in the open position. The image forming apparatus further comprises a holding unit configured to releasably hold the end portion of the feed guide in the open position.

17 Claims, 11 Drawing Sheets

IMAGE FORMING APPARATUS WITH MOVABLE FEED GUIDE

CROSS-REFERENCE TO RELATED APPLICATION

This application is based upon and claims the benefit of priority from Japanese Patent Application No. 2012-233267, filed Oct. 22, 2012, the entire contents of which are incorporated herein by reference.

FIELD

Embodiments described herein relate generally to a mechanism which provides for removal of a sheet jam in an image forming apparatus.

BACKGROUND

When a sheet jam, sometimes referred to as a "jam," is caused within a fixing unit or other positions of an image forming apparatus, a user of the image forming apparatus is required to remove the jammed sheet.

According to an image forming apparatus in the related art, a cover or the like of the image forming apparatus is brought into an open condition to remove a jammed sheet at the time of a jam. During this removal, the angle of visibility of the user is obscured by a projecting portion of a guide provided in a fixing unit to feed a sheet, or by a projecting portion of a scanning unit. In this case, the visual recognition of the jammed sheet is inadequate.

In a condition in which a feed guide of the fixing unit is opened to remove a jammed sheet, the angle of visibility of the user is narrowed by a corner of an original carrying plate or by a projecting portion when the feed guide is opened.

Moreover, the size of the image forming apparatus has been reduced in recent years, including a tendency of narrowing a distance between the original carrying plate and the fixing unit with the size reduction of the image forming apparatus. In this case, the angle of visibility of the user further narrows.

Accordingly, viewing the interior of the fixing unit from the upper side becomes difficult. In such a case, the user is required to go around toward the side behind the image forming apparatus in order to remove a sheet jam caused in the fixing unit, depending on the particular image forming apparatus. Particularly, a small-sized image forming apparatus developed for A4 sheet printing may be installed in various places, including a position on a table. When this type of image forming apparatus is installed on a table, there is a possibility that the vision or posture of the user removing a jam is different than in situations assumed during design of the apparatus, depending on the height of the table or other factors. In other words, the vision or posture of the user removing a jam for such a table-installed image forming apparatus is unlike that for a large-sized image forming apparatus (directly installed on a floor) employed in businesses and the like. Accordingly, the visual recognition of the jamming sheet needs to be raised to the highest possible level.

Furthermore, according to the image forming apparatus in the related art, the user initially opens a side cover, and then opens the feed guide when a jam is caused in the fixing unit. Then, the feed guide is opened by shifting the tip thereof downward around the center of the rotation axis. After the sheet is removed, the feed guide previously opened is brought into a closed condition by shifting the tip thereof upward. Thereafter, the side cover is closed.

When the user leaves the feed guide open, the side cover contacts the tip of the feed guide, producing a possibility of breakage of the contact portion or the like. For avoiding this problem, a spring can be provided on the feed guide for automatically closing the feed guide. According to this method, however, removal of the sheet needs to be conducted by one hand while the feed guide is pressed by the other hand at the time of removal of the sheet. In this case, sheet removing becomes a difficult task.

DETAILED DESCRIPTION

An image forming apparatus according to an embodiment comprises a feed guide forming a feed path of a sheet and having an end portion movable between a closed position and an open position by rotating around a shaft, wherein the end portion is positioned above the shaft when the feed guide is in the open position, and the feed guide is configured to provide access for removal of a jammed sheet when in the open position. The image forming apparatus further comprises a holding unit configured to releasably hold the end portion of the feed guide in the open position.

An embodiment described herein chiefly includes the following four points.

1. Upward opening of feed guide inside fixing unit: In the prior art, a feed guide provided within a fixing unit in the related art opens downward, thus a projecting portion on the feed guide narrows the angle of visibility. According to present disclosure, the feed guide opens upward so that a projecting portion is unnecessary, allowing easy recognition and easy removal of a jammed sheet.

2. Feed guide holding mechanism: In the prior art, the feed guide may close by the weight of the feed guide or from contact with the hand at the time of removal of the sheet, when the feed guide only opens upward, as described above. According to the present disclosure, a mechanism for holding the feed guide is provided.
3. Recessed shape of original sheet carrying table: According to the present disclosure, a recessed shape of a side wall of an original sheet carrying table on the side cover side allows easy visual recognition of the interior of the fixing unit when the side cover and the feed guide are brought into the open condition.
4. Mechanism for detecting closed condition of feed guide: there is a possibility of contact between the feed guide and the side cover when the side cover is closed and the feed guide is opened. For avoiding this problem, a sheet feed detecting mechanism provided within the fixing unit is used to detect whether the feed guide is in the open condition.

An image forming apparatus according to this embodiment is hereinafter described with reference to the drawings. X, Y, and Z coordinate axes shown in the respective figures cross each other at right angles, as axes common to all the figures.

Figure 1A:
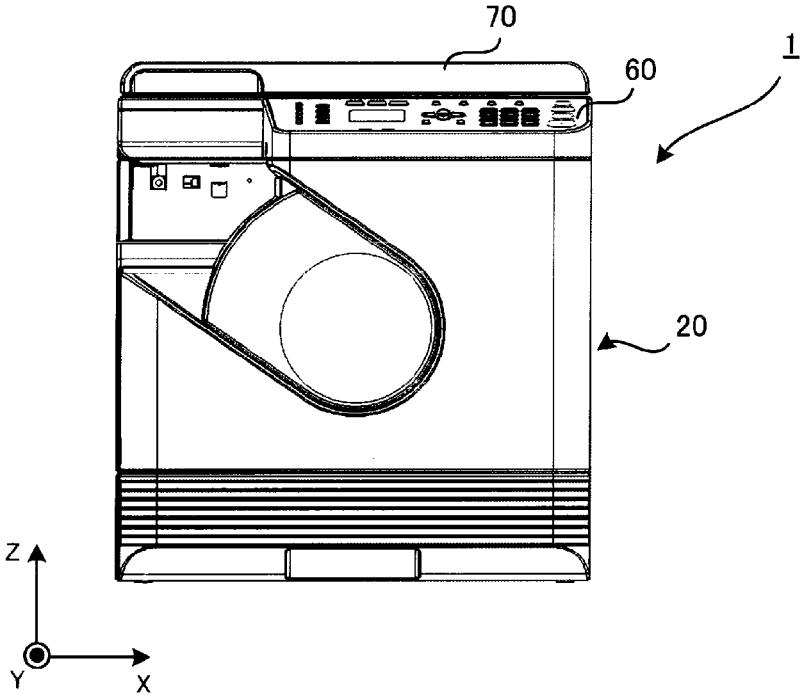
FIG. 1A illustrates a side view of an image forming apparatus according to an embodiment.
Figure 1B:
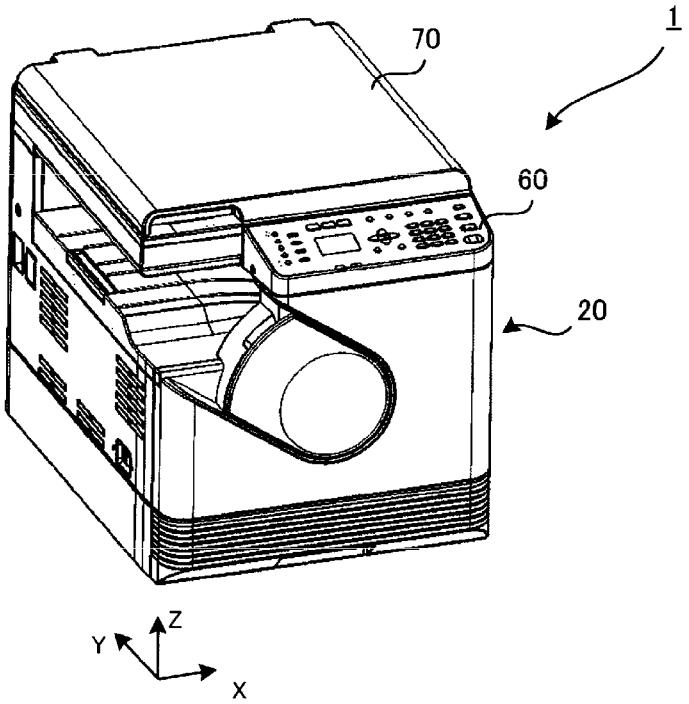
FIG. 1B illustrates a perspective view of the image forming apparatus.
Figure 2:
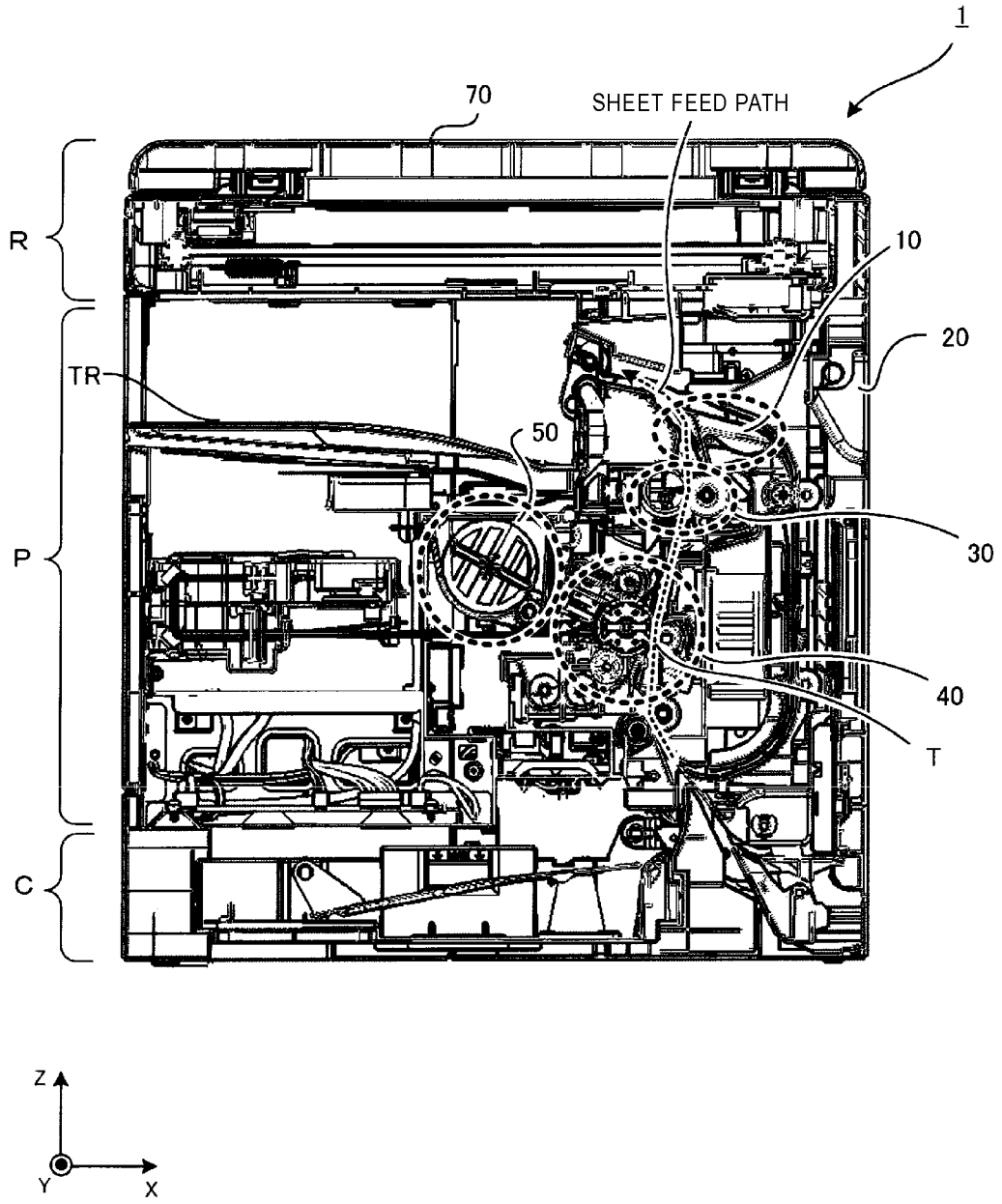
FIG. 2 is a cross-sectional view of the image forming apparatus according to the embodiment.

FIG. 1A is a side view of the image forming apparatus according to the embodiment. FIG. 1B is a perspective view of the image forming apparatus. FIG. 2 is a cross-sectional view of FIG. 1A. An image forming apparatus 1 includes a reading unit R, an image forming unit P, and a cassette unit C. Sheets stacked on the cassette unit C are picked up by a pickup roller (not-shown), and fed to the image forming unit P of the image forming apparatus 1. The sheets are conveyed along a sheet conveying path indicated by an arrow with a broken line in FIG. 2 within the image forming unit P.

An image to be printed is transferred to a sheet fed to the image forming unit P by a process unit 40. This image may be a scan image of an original read by the reading unit R, or may be an image of printing data transmitted from an external device (such as a computer). An electrostatic latent image of the image is formed on a photosensitive body within the process unit 40.

A toner cartridge 50 contains developer and supplies the developer to the process unit 40. The electrostatic latent image formed on the photosensitive surface of the photosensitive body is developed by the supplied developer, and transferred to the sheet at a transfer position T.

The sheet having the image is fed to a fixing unit 30 disposed on the downstream side, and heat-treated. As a result, the image is fixed to the sheet. Then, the sheet is discharged from the image forming unit P toward a tray TR along the shape of the feed guide 10, and stacked on the tray TR.

The image forming apparatus 1 has a side cover 20 (i.e., a side wall opening portion) through which a sheet may be removed at the time of a jam and through which the inside units may be accessed. The side cover 20 forms the external wall of one side surface of the image forming apparatus 1. At the time of removal of a jammed sheet by the user, the user manually opens the side cover 20 and the upper end of the side cover 20 rotates downward. The side cover 20 may include internal components of the image forming apparatus 1 as well as the external wall, and opens together with these components combined as one body.

As illustrated in FIGS. 1A and 1B, the image forming apparatus 1 includes a control panel 60. The control panel includes a keyboard which receives instructions for specifying the number of sheets and the number of copies for printing, and for the start of printing from the user. The control panel 60 also includes a display (notifying unit) which displays massages and processing conditions to the user.

The various components of the image forming apparatus 1 are subject to control by a control board (not shown). The control board includes a processing unit such as a CPU, and a memory unit such as a volatile memory device and a non-volatile memory device. The processing unit executes programs stored in the memory unit to perform various processes and controls. Apart or all of the functions performed by the control board may be implemented by an application specific integrated circuit (ASIC).

A platen cover 70 shown in FIGS. 1A and 1B is similar to a platen cover equipped in the related art, and has the function of pressing an original placed on an original sheet carrying table in the downward direction. The platen cover 70 is detachably attached to the image forming apparatus 1. Depending on circumstances, an auto document feeder (ADF) 70A functioning as an automated original feeding device may be attached to the image forming apparatus 1 as substitute for the platen cover 70. The details of the ADF 70A will be described later.

Figure 3A:
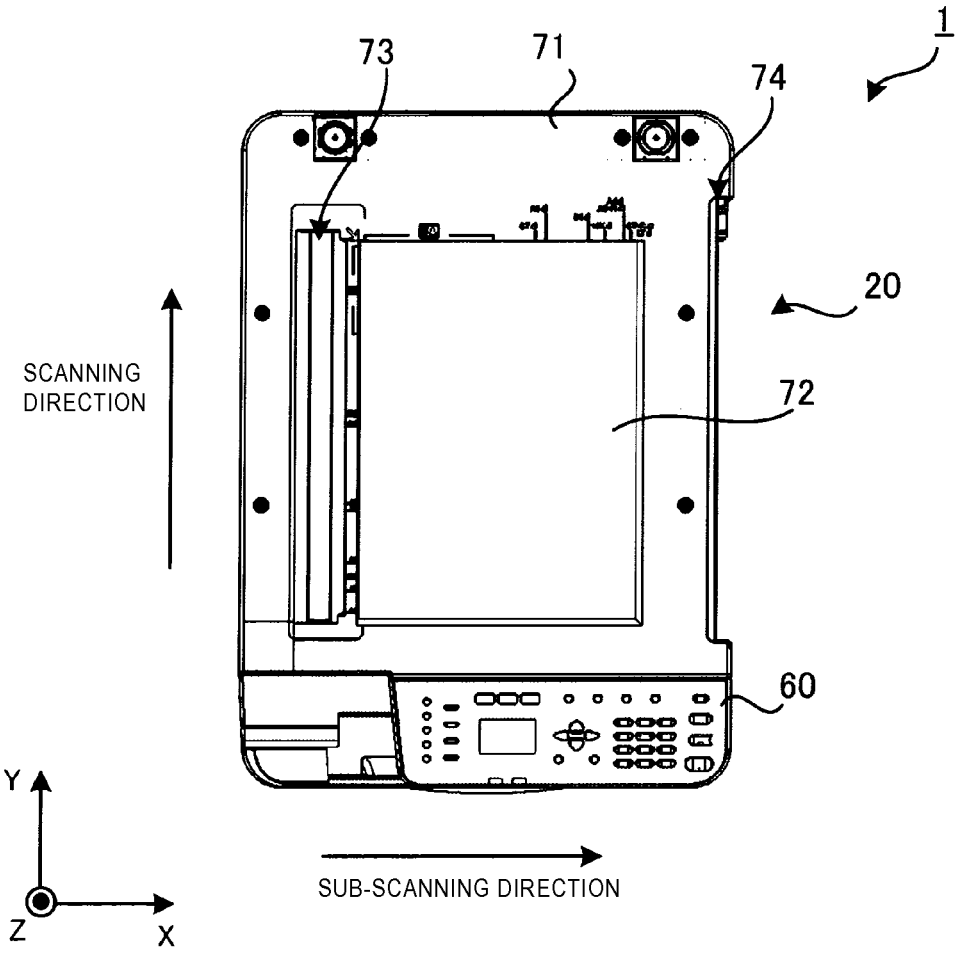
FIG. 3A is a top view of the image forming apparatus from which a platen cover is removed.
Figure 3B:
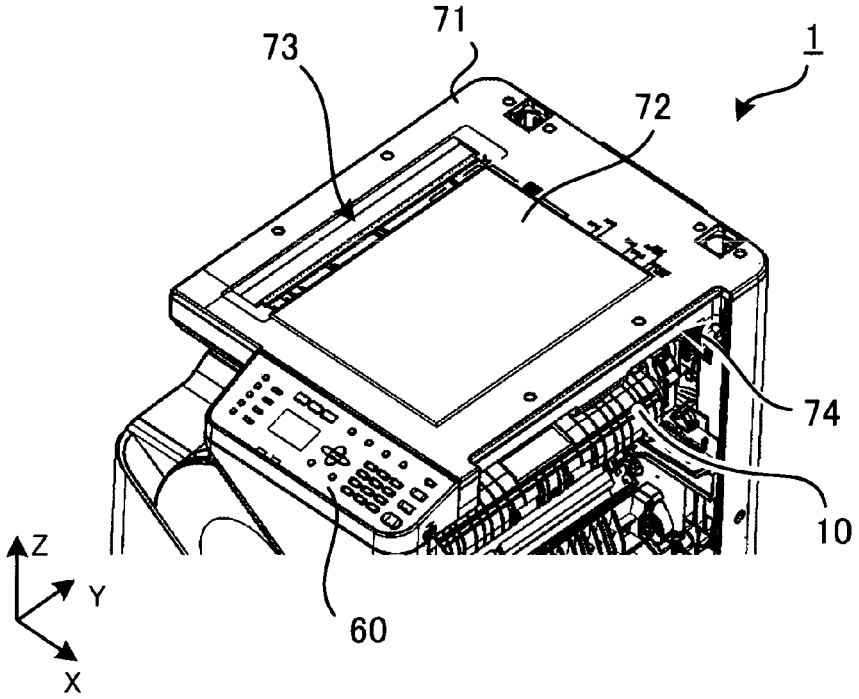
FIG. 3B is a perspective view of the image forming apparatus from which the platen cover is removed.

FIG. 3A is a top view of the image forming apparatus 1, illustrating the condition in which the platen cover 70 is removed. FIG. 3B is a perspective view thereof. FIG. 3B also illustrates the case when the side cover 20 is in the open condition. An original sheet carrying table 71 (original carrying unit) includes a transparent glass plate 72 on which an original sheet to be printed is placed. A transparent glass plate 73 functions as a reading window when the original sheet is automatically supplied by the ADF 70A. The reading unit R performs line-scanning in the scanning direction (Y-axis direction), and shifts a light emitter in the sub-scanning direction (X-axis direction) using a carriage, so that the surface of the original sheet placed on the transparent glass plate 72 can be read through these operations. On the other hand, for an original sheet automatically fed by the ADF 70A, the light emitter is not shifted in the sub-scanning direction but located below the transparent glass plate 73 in the Z-axis direction. In this case, the original sheet is shifted by the automatic feed of the ADF 70A for line-scanning. An image thus obtained is converted into an electric signal by an image pickup element such as a charge coupled device image sensor (CCD image sensor), and stored in the memory unit of the control board as image data.

The original sheet carrying table 71 is so shaped that a part of the side surface wall thereof on the side cover 20 side is cut away to form a recess portion 74. The recess portion 74 is disposed above the side cover 20 in the Z-axis direction. The recess portion 74 has a longitudinal shape in the scanning direction, and is longer than at least the lengths of transparent glass plates 72 and 73 in the scanning direction. When the ends of the recess portion 74 are linearly projected in the direction opposite the X axis towards the Y axis, the projected lines of the recess portion 74 contains all lines of the transparent glass plates 72 and 73 that are likewise projected in the direction opposite the X axis towards the Y axis. The cut-off shape of the recess portion 74 extends from the upper surface to the lower surface of the original sheet carrying table 71.

The recess portion 74 thus formed in the sheet carrying table 71 can improve the visual recognition of the interior from above at the time of a jam or attachment and detachment of the inside units, and can widen the angle of visibility.

Figure 4:
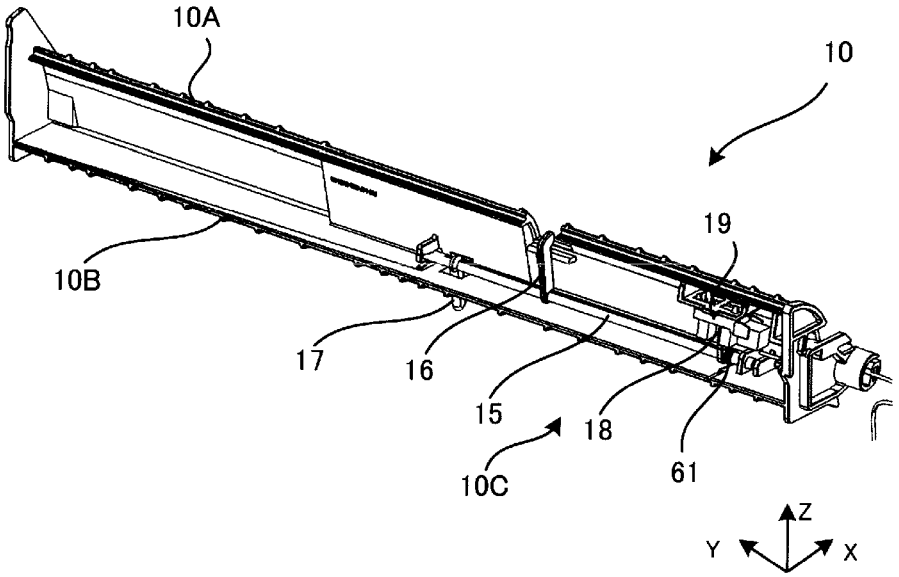
FIG. 4 illustrates an example of a feed guide according to the embodiment.

FIG. 4 illustrates an example of a feed guide 10. It should be noted that the viewing direction in the perspective view of FIG. 4 is different from that direction in the other perspective figures, as indicated by the reference X, Y, and Z axes. The feed guide 10 includes an upper wall 10A and a lower wall 10B. The lower surface of the lower wall 10B forms a part of the feed path, through which the sheet passes, after the fixing process. The feed guide 10 further includes a detecting unit 10C. The detecting unit 10C detects opening and closing of the feed guide 10, using a related-art sensor unit which monitors the feed position of the sheet. The detecting unit 10C includes a shaft 15, an opening and closing detection arm 16, a feed detection arm 17, a dog 18, a photoelectric sensor 19, and a spring 61. The details of the detecting unit 10C will be described later.

Figure 5A:
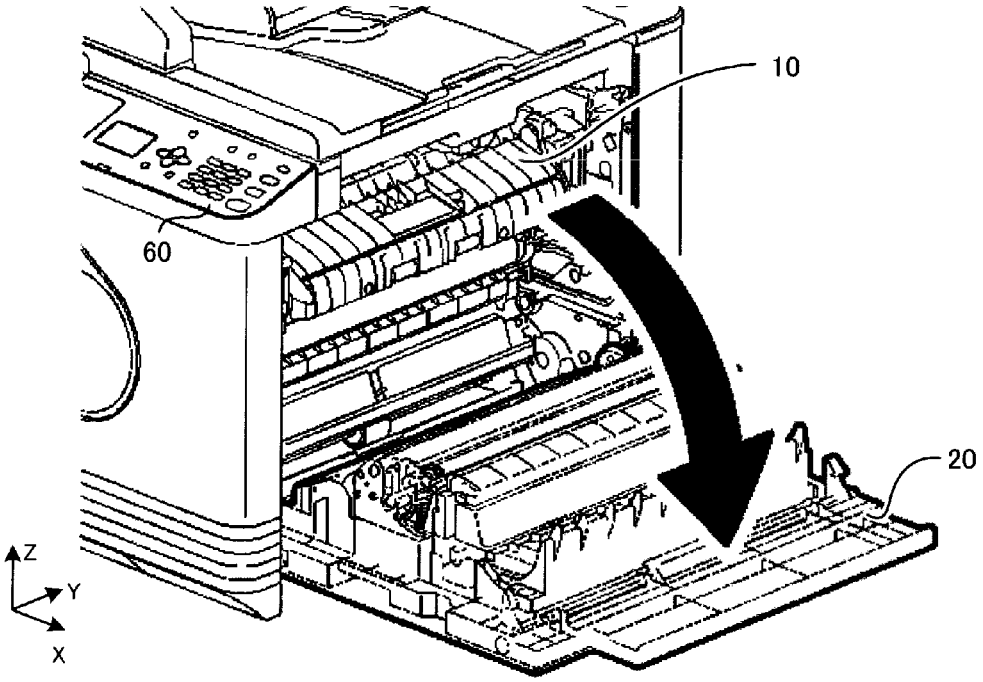
FIG. 5A illustrates the opening direction of a side cover and the feed guide at the time of removal of a sheet.
Figure 5B:
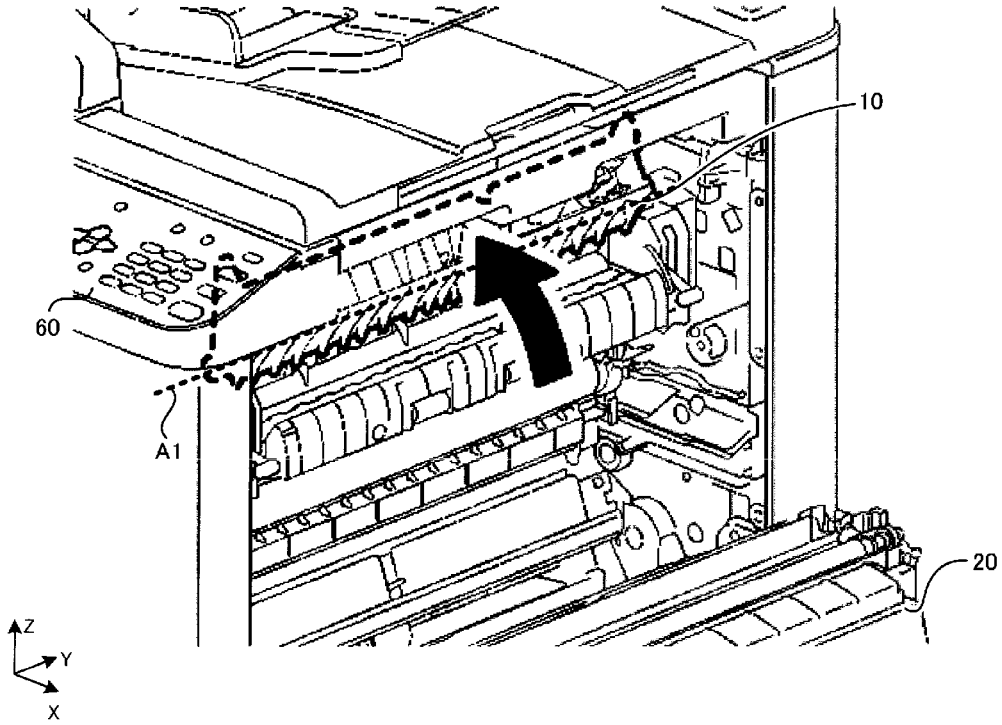
FIG. 5B illustrates the closing direction of the side cover and the feed guide at the time of removal of the sheet.

FIGS. 5A and 5B illustrate the respective opening portions are brought into the open position, for removing a jammed sheet within the feed path after the fixing process by the fixing unit 30. When a jam is caused after fixing, the user initially rotates the side cover 20 downward around a predetermined rotation axis to bring the side cover 20 into the open condition (FIG. 5A). When the side cover 20 is opened, the interior of the image forming apparatus 1 is exposed. In this condition, the feed guide 10 is also exposed. Then, the feed guide 10 is opened by rotation of one end of the feed guide 10 in the upward direction around the axial center by the manual operation of the user (FIG. 5B). A rotation axis A1 (see FIG. 5B) extends in parallel with the Y axis, and also in parallel with the scanning direction of the reading unit R. In addition, the rotation axis A1 extends in the direction perpendicular to the sheet feed direction, and perpendicular to the normal line of the surface of the sheet to be fed. A holding mechanism holds the feed guide 10 in this open position. The jammed sheet is exposed through the opening of the feed guide 10, and can be removed therefrom by the user.

Upon release of the holding mechanism (described below), the end of the feed guide 10 returns downward by weight of the feed guide 10, and comes into the closed condition.

Figure 6A:
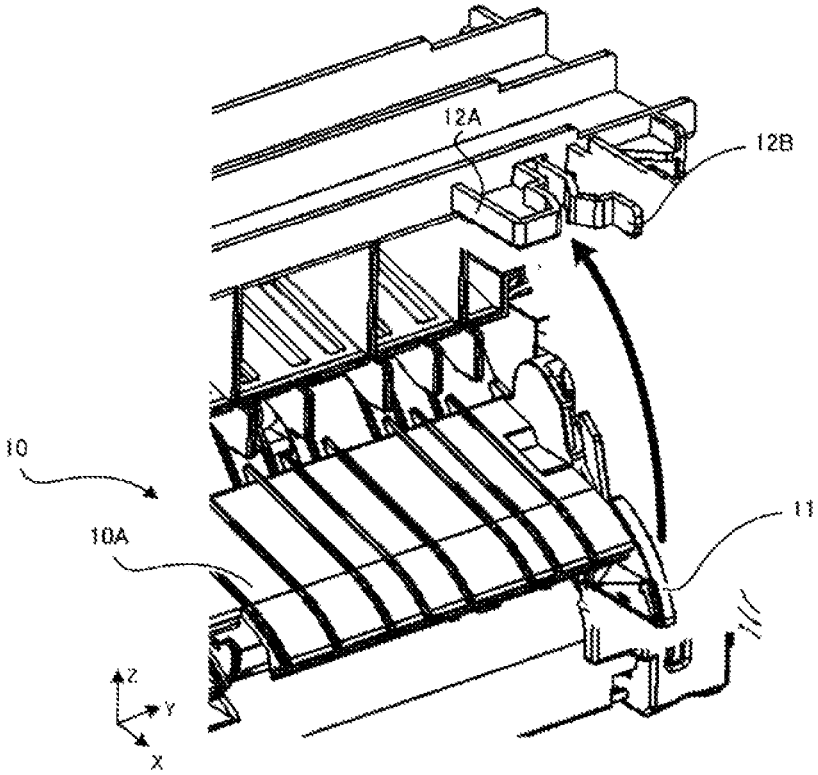
FIG. 6A illustrates a close-up perspective view of a mechanism which maintains an open condition of the feed guide.
Figure 6B:
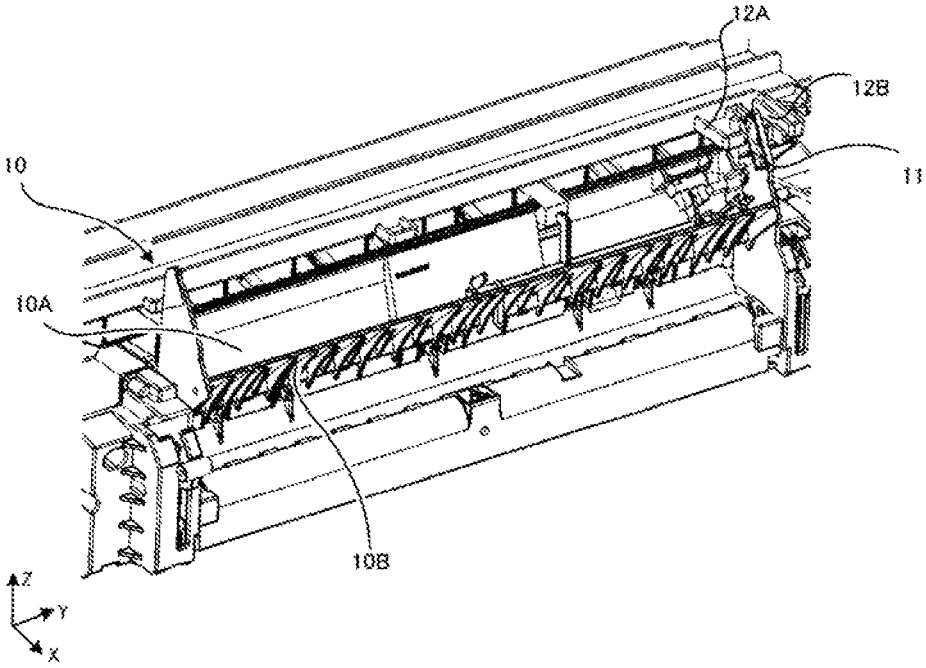
FIG. 6B illustrates a larger perspective view of the mechanism which maintains the open condition of the feed guide.

The details of a holding mechanism provided for this purpose are now explained with reference to FIGS. 6A and 6B. The feed guide 10 further includes a held member 11 located on the side wall thereof (see FIG. 6A). Above the feed guide 10, there are further provided holding members 12A and 12B fixed to the main body of the image forming apparatus 1. When the held member 11 of the feed guide 10 is sandwiched between the holding members 12A and 12B, the end of the feed guide 10 is held in the open position described above. FIG. 6B illustrates this condition. The materials of the held member 11 and the holding members 12A and 12B may be any suitable materials as long as the frictional force of the materials produced by contact between the respective members 11 and 12A and 12B can prevent accidental closing of the feed guide 10 in the downward direction.

Figure 7:
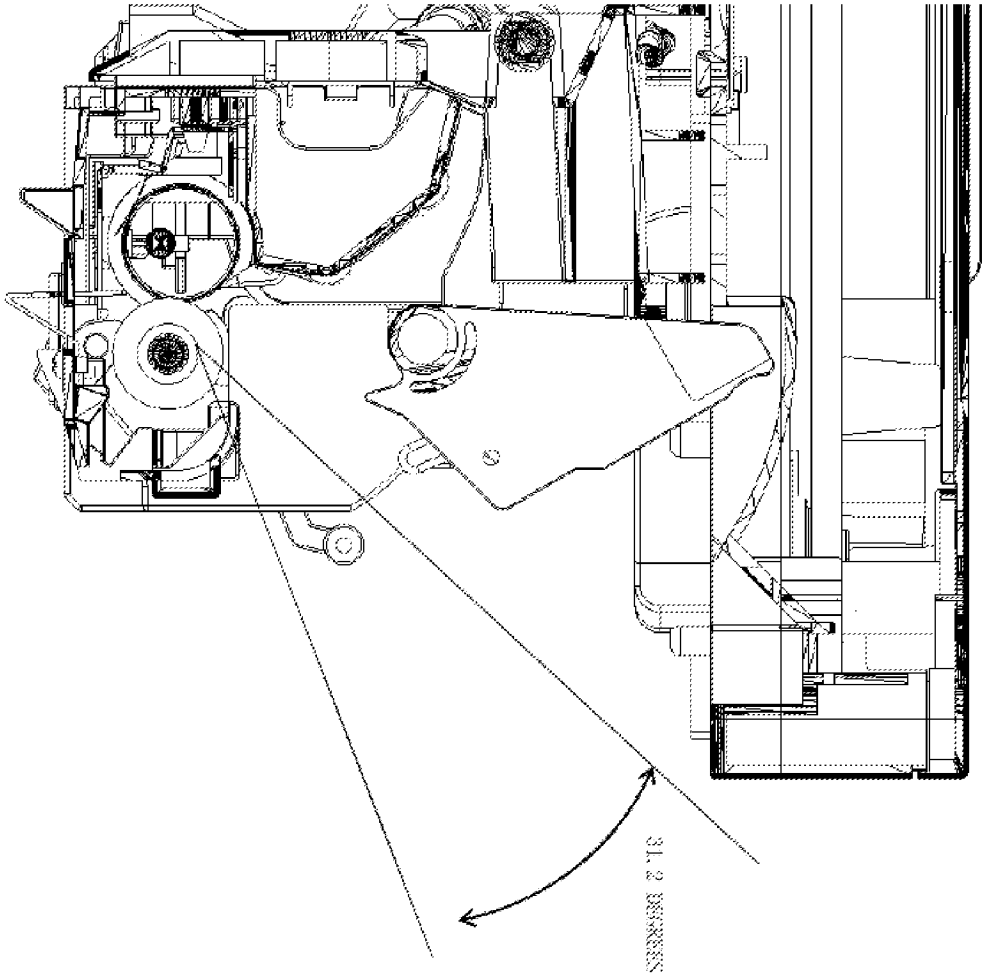
FIG. 7 illustrates an example of an angle of visibility produced, according to the embodiment.

When the feed guide 10 is held by the holding members 12A and 12B in the open position, the angle of visibility of the user for visual recognition widens. FIG. 7 illustrates an example of the angle of visibility when the end of the feed guide 10 is in the open position described above. According to this embodiment, the angle of visibility may be as large as 31.2 degrees, which can realize a broad angle of visibility. Moreover, the open position of the end of the feed guide 10 described above is maintained by the holding unit comprised of the held member 11 and the holding members 12A and 12B. Accordingly, the user can remove the jammed sheet by using both of the hands (i.e., without having to hold the feed guide 10 in the open position with one hand).

Figure 8:
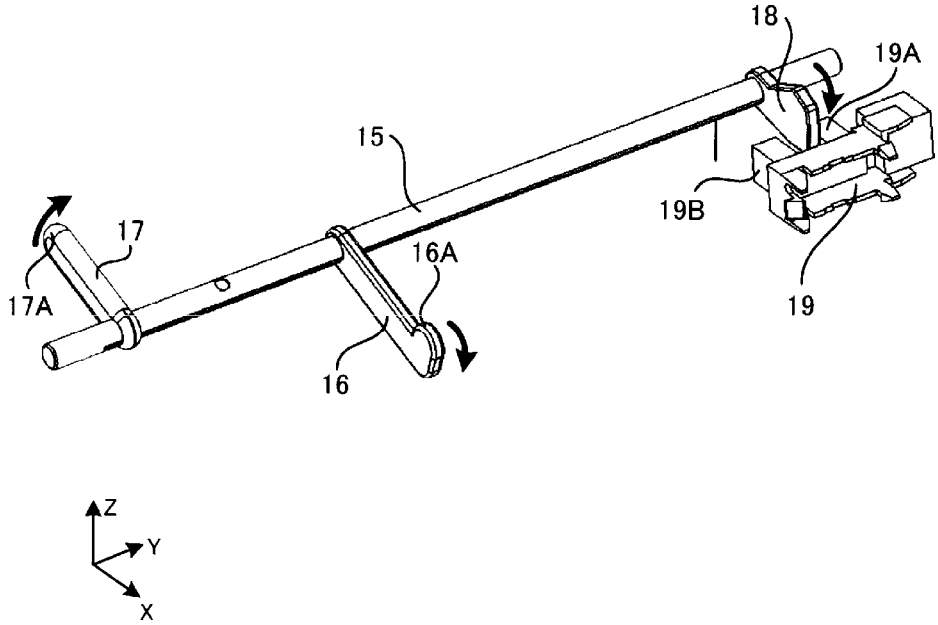
FIG. 8 illustrates a mechanism which detects feed of a sheet and the open condition of the feed guide, according to the embodiment.

The details of the detecting unit 10C are now explained. FIG. 8 illustrates an example of the detecting unit 10C, showing the position of the detecting unit 10C when the feed guide 10 is in the closed condition. As explained above with reference to FIG. 4, the detecting unit 10C includes the shaft 15, the opening and closing detection arm 16, the feed detection arm 17, the dog 18, the photoelectric sensor 19, and the spring 61 (the spring 61 is not shown in FIG. 8). One end of each of the opening and closing detection arm 16, the feed detection arm 17, and the dog 18 are fixed to the shaft 15 to rotate around the shaft 15. A light emitter 19A of the photoelectric sensor constantly emits light toward a light receiver 19B. According to this embodiment, the condition in which the light receiver 19B receives the light is defined as an OFF condition, while the condition in which the light receiver 19B does not receive the light is defined as an ON condition. In the ON condition, the photoelectric sensor 19 outputs a detection signal to the control board.

FIG. 8 illustrates the condition in which neither of the passage of the sheet through the feed position nor the opening of the feed guide 10 is detected, corresponding to the condition in which the light receiver 19B receives light emitted from the light emitter 19A (OFF condition). Under the OFF condition, the sheet (after fixing process) is fed and brought into contact with a tip 17A of the feed detection arm 17, whereby the feed detection arm 17 rotates around the shaft 15 in the direction indicated by arrows. As a result, the shaft 15 also rotates in the direction of the arrows. As the shaft 15 rotates, the dog 18 also rotates, coming to a position between the light emitting position of the light emitter 19A of the photoelectric sensor 19 and the light receiving position of the light receiver 19B. Consequently, the light emitted from the light emitter 19A is blocked, wherefore the condition becomes the ON condition and the detection signal is output. Accordingly, the feed of the sheet at the predetermined position is detected.

The spring 61 provides a rotational force to the feed detection arm 17 in the direction opposite to the direction of the arrows in FIG. 8, for the purpose of returning a current position to the original position.

Figure 9A:
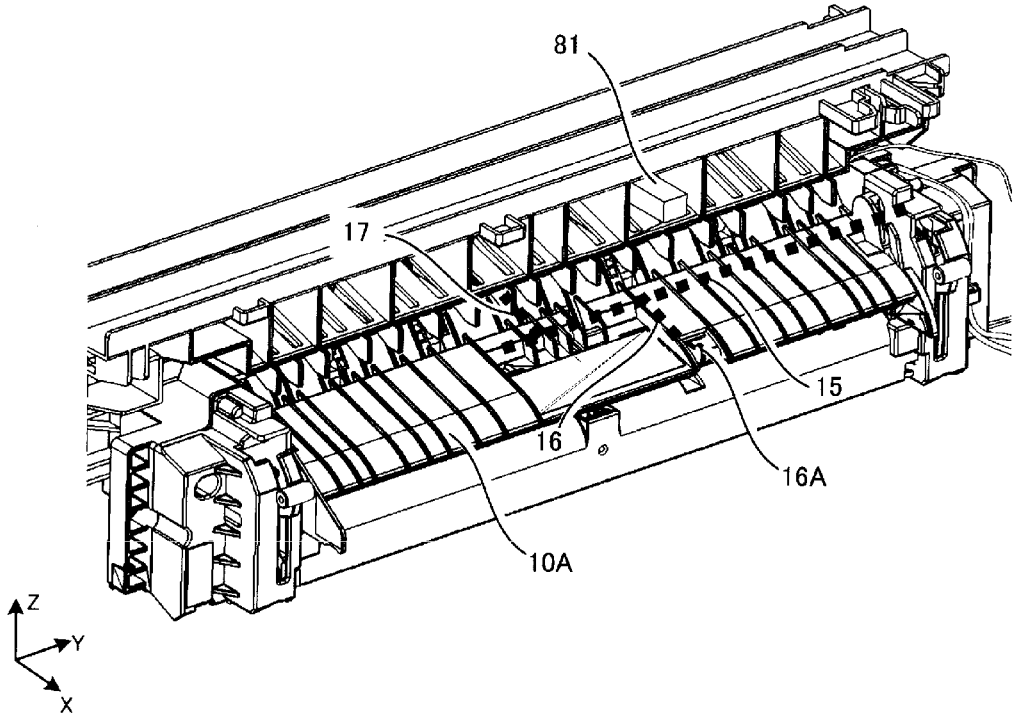
FIG. 9A illustrates the closed condition of the feed guide, according to the embodiment.
Figure 9B:
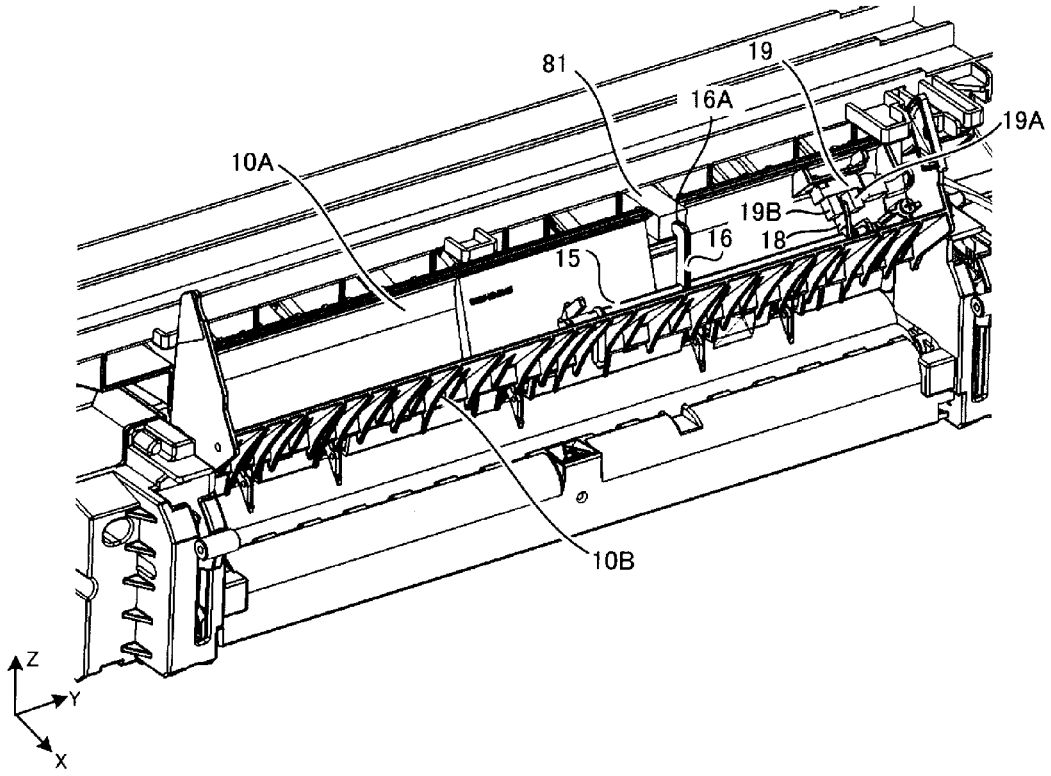
FIG. 9B illustrate the open condition of the feed guide according to the embodiment.

A related-art technology may be adopted for feed detection of the sheet. According to this embodiment, the opening and closing detection arm 16 is also provided on the detecting mechanism to detect the open condition of the feed guide 10. FIG. 9A shows the position of the detecting unit 10C, indicated by a broken line, when the feed guide 10 is in the closed condition. FIG. 9B shows the feed guide 10 is in the open position. When the feed guide 10 is in the open position, the detecting unit 10C is exposed as illustrated in FIG. 9B. Furthermore, when the feed guide 10 is in the open position, an L-shaped end 16A of the opening and closing detection arm 16 comes into a position located above the shaft 15, along with the end of the dog 18 in a similar position above the shaft 15, as described above. The photoelectric sensor 19 is fixed to the upper wall 10A of the feed guide 10.

A stopper 81 is disposed above the feed guide 10 and fixed to the main body side of the image forming apparatus 1. When the feed guide 10 is in the open position, the L-shaped end 16A is brought into contact with the stopper 81. By this contact, the opening and closing detection arm 16 rotates in the direction of the arrows in FIG. 8, and the dog 18 similarly rotates in the direction of the arrows in FIG. 8. As a result, the dog 18 comes to a position between the light emitting position of the light emitter 19A and the light receiving position of the light receiver 19B. Consequently, the light emitted from the light emitter 19A is interrupted, triggering the ON condition in which the detection signal is output to indicate the open position of the feed guide 10. The projection length of the stopper 81, and the L shape of the opening and closing detection arm 16, particularly the length between the bended portion of the L shape and the farthest end thereof in direct contact with the stopper 81, are adjusted such that the dog 18 comes to a position for blocking the light to the photoelectric sensor 19 when the feed guide 10 is brought into the open position.

Figure 10:
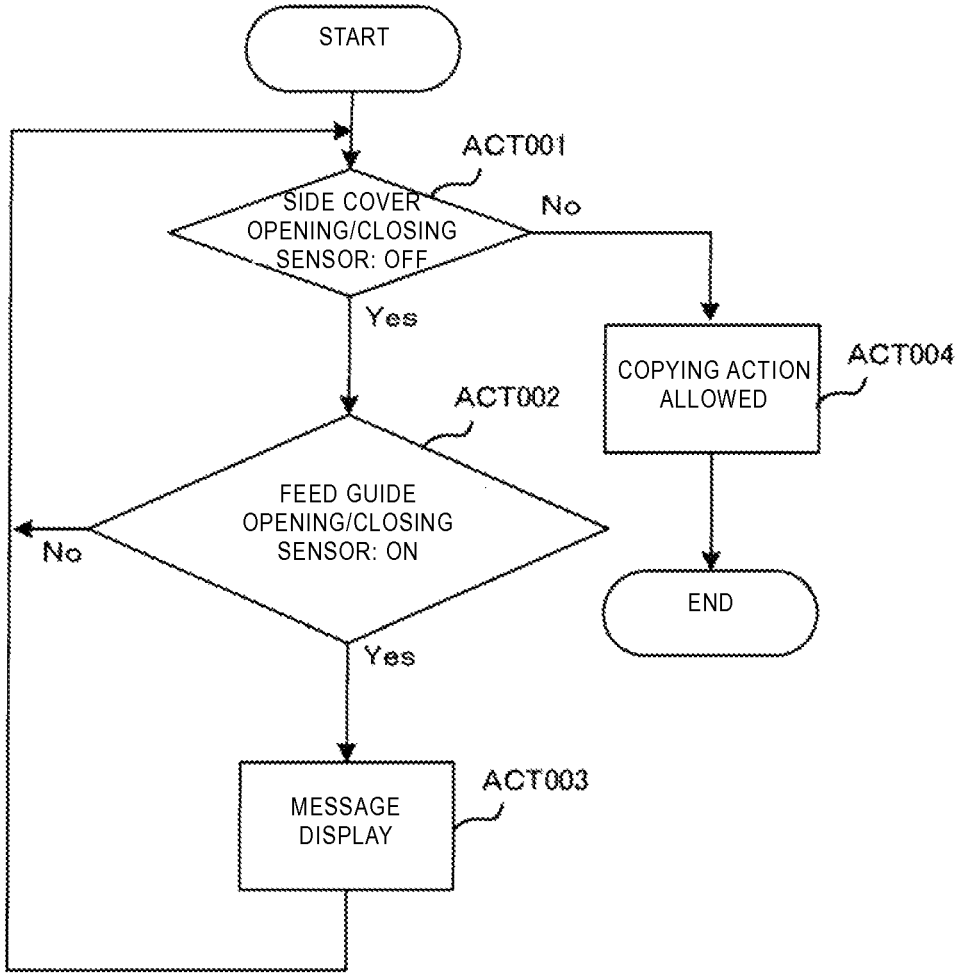
FIG. 10 is a flowchart showing a control operation at the time of detection of the open condition of the feed guide, according to the embodiment.

FIG. 10 is a flowchart showing a control operation performed at the time of the feed guide 10 being detected in the open position by the detecting unit 10C. The operation in this flowchart is implemented on the above-discussed control board provided within the image forming apparatus 1. The control board wired with the photoelectric sensor 19 receives the detection signal from the photoelectric sensor 19 and controls the respective units of hardware. When the control board includes a CPU and volatile or non-volatile memory devices, programs stored in the non-volatile memory device of the memory unit are loaded to the volatile memory device and executed for processing by using the CPU so as to perform the functions.

Initially, when the sensor which detects the opening and closing of the side cover 20 is OFF (ACT001: No), which corresponds to the closed condition of the side cover 20, the image forming apparatus 1 is controlled in such a manner that copying action is allowed (ACT004). On the other hand, when this sensor is ON, that is, when the side cover 20 is detected in the open condition (ACT001: Yes), it is determined whether or not the photoelectric sensor 19 of the feed guide 10 is in the ON condition (ACT002). When the ON condition is determined, that is, when the dog 18 blocks the light (ACT002: Yes), the control panel 60 displays a predetermined message (ACT003). According to this embodiment, the message instructs the user to bring the feed guide 10 into the closed condition. The message is displayed together with an error code defined beforehand. This message may be an audio message such as buzzer sound. Then, the flow returns to the determination step in ACT001. On the other hand, when the feed guide 10 is detected in the closed condition or is switched from the open condition to the closed condition (ACT002: No), the flow returns to the determination step in ACT001.

Accordingly, whether the feed guide 10 is in the open condition or not can be detected by using a related-art sheet feed detecting mechanism. By this detection, the user can be notified that the feed guide 10 has been left opened. Moreover, owing to the use of the related-art sheet feed detecting mechanism, there is no need of preparing new sensors or the like.

Figure 11A:
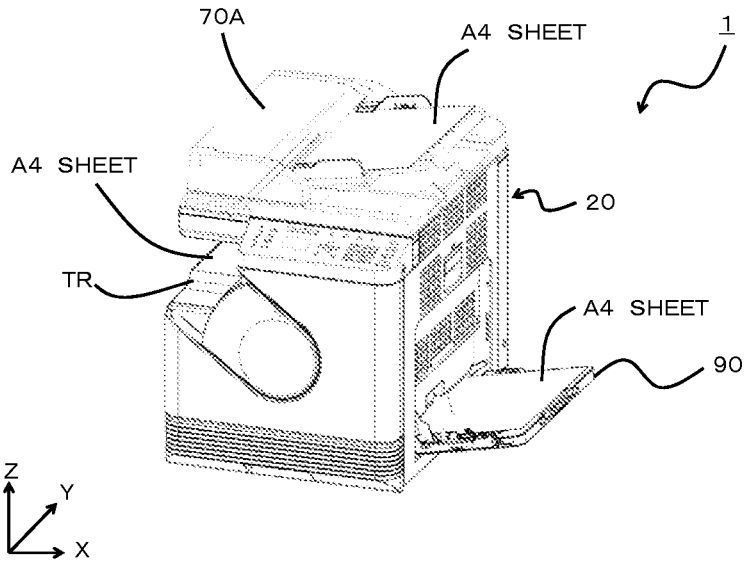
FIG. 11A illustrates a mode of printing on A4 sheets by using the image forming apparatus, according to the embodiment.
Figure 11B:
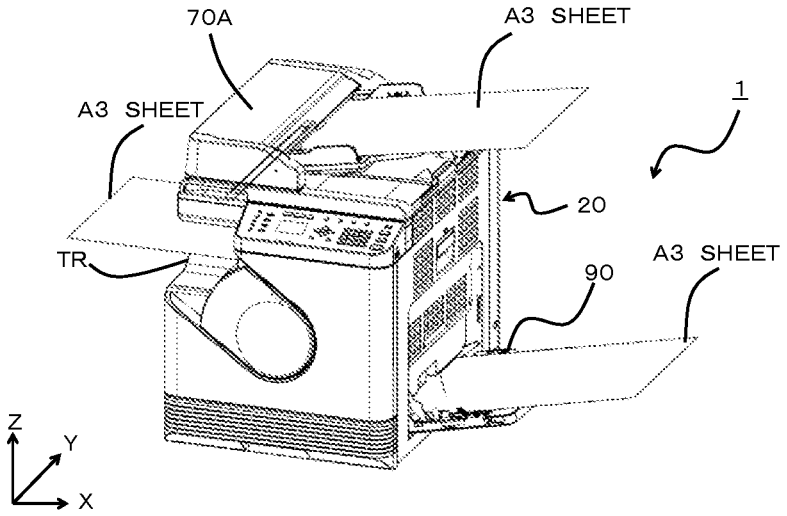
FIG. 11B illustrate a mode of printing on A3 sheets by using the image forming apparatus, according to the embodiment.

Furthermore, the image forming apparatus 1 can perform printing not only on A4 sheets but also on A3 sheets. This mode is now explained with reference to FIGS. 11A and 11B. FIGS. 13A and 13B illustrate image forming apparatus with the ADF 70A mounted in lieu of the platen cover 70. FIG. 11A shows the condition of printing on A4 sheets, while FIG. 11B shows the condition of printing on A3 sheets. New sheets to be printed are stacked on a tray 90 provided on the side cover 20. As illustrated in FIGS. 11A and 11B, the ADF 70A carries a stack of original A4 sheets (FIG. 11A), and original A3 sheets (FIG. 11B) to allow automatic feed of the original sheets. The original sheets that are automatically fed are read via the transparent glass plate 73 shown in FIGS. 3A and 3B, and converted into electronic data. Then, images corresponding to the electronic data are transferred to the sheets by the process unit 40, and heated for fixing by the fixing unit 30. By these processes, the sheets on which the images are formed are discharged to the tray TR.

As apparent from the detailed description of the embodiment herein, a jammed sheet can be removed with high efficiency at the time of a sheet jam, according to the disclosed embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a feed guide forming a feed path of a sheet and having an end portion movable between a closed position and an open position by rotating around a shaft, wherein the end portion is positioned above the shaft when the feed guide is in the open position, and the feed guide is configured to provide access for removal of a jammed sheet when in the open position;

a holding unit configured to releasably hold the end portion of the feed guide in the open position;

a side wall opening portion forming an external wall of one side surface of the image forming apparatus and configured to open to provide access to the feed guide for removal of the jammed sheet; and an original carrying unit comprising a transparent plate on an upper surface on which a sheet to be scanned is placed, and a recess portion on the one side surface side of the upper surface, the recess portion shaped and configured to receive a top portion of the side wall opening portion when the side wall opening portion is closed.

2. The apparatus according to claim 1, further comprising:

a detecting unit configured to detect whether or not a sheet to be fed reaches the feed guide, and to detect whether or not the end portion of the feed guide is in the open position.

3. The apparatus according to claim 2, wherein the detecting unit comprises:

a feed detection arm configured to rotate about a shaft when a sheet reaches the feed guide, and an opening and closing detection arm configured to rotate about the shaft and contact a stopper on a main body of the image forming apparatus when the end portion of the feed guide is in the open position.

4. The apparatus according to claim 2, further comprising:

a notifying unit configured to provide a message when the detecting unit detects that the end portion of the feed guide is in the open position.

5. The apparatus according to claim 1, wherein the feed guide forms the feed path through which the sheet is conveyed after the sheet is conveyed through a fixing unit.

6. The apparatus according to claim 1, wherein the holding unit comprises a first member on the feed guide and at least a second member on a main body of the image forming apparatus, the second member releasably holding the first member when the end portion of the feed guide is held in the open position, wherein release of the second member allows the end portion of the feed guide to move from the open position to the closed position due to gravity.

7. A method of removing a jammed sheet from an image forming apparatus having a feed guide forming a feed path of a sheet and having an end portion movable between a closed position and an open position by rotating around a shaft, and a holding unit configured to releasably hold the end portion of the feed guide in the open position, the method comprising:

rotating the end portion to the open position so that the end portion is positioned above the shaft;

holding the end portion in the open position with the holding unit;

removing the jammed sheet when the end portion is held in the open position;

detecting, with a detecting unit, when a sheet to be fed reaches the feed guide; and detecting, with the detecting unit, when the end portion of the feed guide is in the open position.

8. The method according to claim 7, further comprising:

opening a side wall opening portion that forms an external wall of one side surface of the image forming apparatus prior to rotating the end portion of the feed guide.

9. The method according to claim 8, wherein the image forming apparatus further includes an original carrying unit comprising a transparent plate on an upper surface on which a sheet to be scanned is placed, and a recess portion on the one side surface side of the upper surface, the recess portion shaped and configured to receive a top portion of the side wall opening portion when the side wall opening portion is closed.

10. The method according to claim 7, wherein the detecting unit comprises a feed detection arm configured to rotate about a shaft when a sheet reaches the feed guide, and an opening and closing detection arm configured to rotate about the shaft and contact a stopper on a main body of the image forming apparatus when the end portion of the feed guide is in the open position.

11. The method according to claim 7, further comprising:

providing a message when the end portion of the feed guide is detected in the open position.

12. The method according to claim 7, wherein the feed guide forms the feed path through which the sheet is conveyed after the sheet is conveyed through a fixing unit.

13. The method according to claim 7, wherein the holding unit comprises a first member on the sheet feed unit and at least a second member on a main body of the image forming apparatus, the second member releasably holding the first member when the end portion of the feed guide is held in the open position, the method further comprising:

releasing the second member to allow gravity to move the end portion of the feed guide from the open position to the closed position.

14. A feed guide that forms a feed path of a sheet in an image forming apparatus, the feed guide comprising:

an end portion movable between a closed position and an open position by rotating around a shaft, wherein the end portion is positioned above the shaft when the feed guide is in the open position, and the feed guide is configured to provide access for removal of a jammed sheet when in the open position; and a holding member configured to be releasably held by a corresponding member on a main body of the image forming apparatus to hold the end portion of the feed guide in the open position, wherein release of the holding member from the corresponding member allows the end portion of the feed guide to move to the closed position due to gravity.

15. The feed guide according to claim 14, further comprising:

a detecting unit configured to detect whether or not a sheet to be fed reaches the feed guide, and to detect whether or not the end portion of the feed guide is in the open position.

16. The feed guide according to claim 15, wherein the detecting unit comprises:

a feed detection arm configured to rotate about a shaft when a sheet reaches the feed guide, and an opening and closing detection arm configured to rotate about the shaft and contact a stopper on a main body of the image forming apparatus when the end portion of the feed guide is in the open position.

17. The feed guide according to claim 14, wherein the feed guide forms the feed path through which the sheet is conveyed after the sheet is conveyed through a fixing unit.

* * * * *